United States Patent [19]

Yudate et al.

[11] Patent Number: 4,575,412

[45] Date of Patent: Mar. 11, 1986

[54] METHOD FOR PRODUCING A PRECURSOR PITCH FOR CARBON FIBER

[75] Inventors: Kozo Yudate; Ken Nagasawa, both of Chiba, Japan

[73] Assignee: Kawasaki Steel Corporation, Kobe, Japan

[21] Appl. No.: 645,174

[22] Filed: Aug. 28, 1984

[51] Int. Cl.[4] ..... C10C 3/02; C10C 3/08; D01F 9/14

[52] U.S. Cl. ..... 208/45; 208/40; 208/44; 423/447.1; 423/447.4

[58] Field of Search ..... 208/40, 44, 45

[56] References Cited

U.S. PATENT DOCUMENTS

| | | | |
|---|---|---|---|
| 4,184,942 | 1/1980 | Angier et al. | 208/44 |
| 4,277,324 | 7/1981 | Greenwood | 208/45 |
| 4,381,990 | 5/1983 | Noguchi et al. | 208/39 |
| 4,402,928 | 9/1983 | Lewis et al. | 208/45 |
| 4,454,019 | 6/1984 | Izumi et al. | 208/40 |

*Primary Examiner*—Andrew H. Metz
*Assistant Examiner*—Helane Myers
*Attorney, Agent, or Firm*—Balogh, Osann, Kramer, Dvorak, Genova & Traub

[57] ABSTRACT

Precursor pitch to be used for formation of carbon fiber is produced by heating a coal tar soft or middle pitch at a temperature of 350°-500° C. at a first stage to form mesophase, extracting the thus treated pitch with a solvent, separating and removing the solvent insoluble portion including mesophase to obtain a pitch containing no free carbon and further at the second stage heat-treating the pitch containing no free carbon in an inert gas atmosphere under atmospheric pressure or a reduced pressure under the following condition $$600-1.2\,T \leqq \theta \leqq 1{,}800-3.6\,T$$

(provided that $350 \leqq T \leqq 500$)

wherein T(°C.) is the temperature of the heat treatment and $\theta$ (min) is the time for which said temperature is held, to form bulk mesophase pitch containing 20-60% by weight of quinoline insoluble portion.

2 Claims, 1 Drawing Figure

METHOD FOR PRODUCING A PRECURSOR PITCH FOR CARBON FIBER

BACKGROUND OF THE INVENTION

1. Field of the Invention

The present invention relates to a method for producing a precursor pitch for carbon fiber in which coal tar soft or middle pitch having a softening point of 50°-70° C. is subjected to two stages of heat-treatments to form mesophase pitch.

2. Description of the Prior Art

The production of carbon fibers is generally classified into a method using synthetic fibers such as polyacryl nitrile, etc. as the raw material and a method using a petroleum pitch or a coal tar pitch as the raw material in view of the raw material. The former method has the drawbacks that the raw material fiber is expensive and the carbonization yield of the raw material fiber is low. In the latter method, there is the following drawback that the pitch having a good spinnability is poor in the infusibility but the pitch having a good infusibility is poor in the spinnability. Presently commercially available carbon fibers are almost formed by using petroleum pitch as the raw material. But, when the petroleum pitch is used as the raw material, it is essential to effect the removal of insoluble solid components for adjusting the raw material pitch and a variety of specific physical chemical treatments such as hydrogenation, heat treatment and the like and this pitch adjustment and the specific treatments need much labor and time.

When the coal tar pitch is used as the raw material, it is necessary to separate and remove microparticle free carbon having a diameter of less than 1 μm contained in the pitch as the insoluble solid component and in order to improve the spinnability and infusibility, the specific adjustment of pitch, such as use of a plurality of solvents, hydrogenation, heat treatment and the like should be performed. In general, the following properties are demanded as the precursor for carbon fiber.

(1) Containing no insoluble solid components, such as ash, free carbon, etc.
(2) Excellent heat stability.
(3) High melt spinnability.
(4) Infusible treatment is easy.
(5) Carbonization yield is high.
(6) Carbon fibers obtained by melt-spinning of the precursor pitch, subjecting the spun fiber to infusing and carbonizing treatments are excellent in the graphitization and orientation and have the enough strength and Young's modulus to be required in carbon fiber.

SUMMARY OF THE INVENTION

The inventors have diligently studied for obtaining the precursor pitch having the above described properties and found a method for producing the precursor pitch for carbon fiber which satisfactorily satisfy concurrently the above described requirements (1)-(6) necessary for the precursor pitch for carbon fiber by which free carbon in coal tar pitch can be easily removed and which does not need the specific treatments such as hydrogenation and the like.

The present invention provides a method for producing precursor pitch for carbon fiber having high strength and high elasticity which comprises heat-treating a coal tar soft or middle pitch having a softening point of 50°-75° C. at a temperature of 350°-500° C. in an inert gas atmosphere at a first stage to form mesophase, extracting the thus heated coal tar pitch with a solvent to separate and remove the solvent insoluble portion which includes the mesophase, whereby a thermally stable pitch containing no free carbon is obtained, and heat-treating this pitch at a temperature of 350°-500° C. under atmospheric pressure or a reduced pressure in an inert gas atmosphere at a second stage to form bulk mesophase containing 20-60% by weight of quinoline insoluble portion.

DESCRIPTION OF THE PREFERRED EMBODIMENTS

Figure 1:
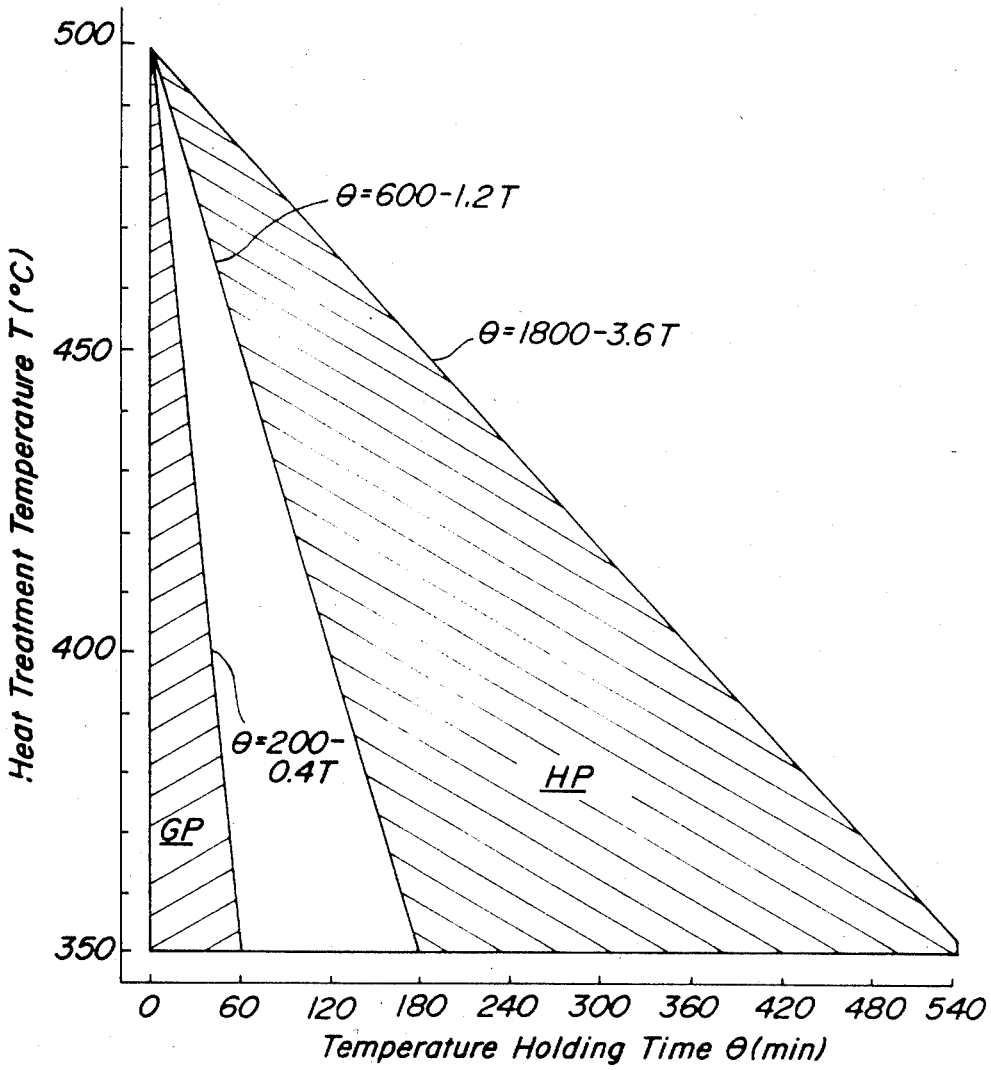
FIG. 1 is a graph showing the relations between the heat treatment temperature (T°C.) in the production of the precursor pitches for carbon fibers and the time ($\theta$ min) holding said temperature.

According to the present invention, the coal tar pitch is heat-treated at the first stage to form mesophase and a solvent insoluble portion including mesophase is separated and removed through extraction with a solvent, whereby free carbon contained in the pitch can be easily removed and the pitch containing no free carbon can be obtained. According to this method, it is possible to easily produce the precursor pitch for carbon fiber which has very high thermal stability, excellent spinnability and infusibility, high carbonization yield and excellent graphitization and orientation without needing the specific treatments such as hydrogenation and the like.

The formation of the mesophase, the growth thereof or the assembling thereof when the pitch is heat-treated, are somewhat different depending upon the kind of the pitch. However, the mesophase is formed at a temperature of about 350° C. and when the temperature is further raised, the formed amount increases and the mesophase is grown into large globular bodies and at about 470° C., the mesophase assembles and at about 500° C., the mesophase is wholly formed into an anisotropic body. In the course of the reaction, the free carbon of fine particles having a diameter of less than 1 μm and inorganic substances which become ash, which are originally present in coal tar pitch, stick around the mesophase globular body, so that they are easily removed.

Furthermore, high molecular weight components having a high thermal reactivity which are present in the pitch and the components having a slight amount of functional group are preferentially polycondensed to form the mesophase, so that the pitch from which these substances are removed, lowers in the heteroatom and is homegeneous and very excellent in the thermal stability.

In the present invention, the pitch was heat-treated at a temperature from about 350° C. at which the mesophase is formed to about 500° C. at which the whole coke formation proceeds, at the first stage. When the temperature of the heat treatment is too high, the mesophase is formed in a large amount and as a result, the yield of the hard pitch lowers and conversely, when the temperature of the heat treatment is too low, the components having a high thermal reactivity are apt to remain in the hard pitch. When these two converse conditions are taken into account, the temperature of the heat treatment is optimum at about 350° C.-500° C. as mentioned above and it is preferable to form 10-30% by weight of the mesophase within this temperature range.

By adding an aromatic solvent to the pitch in which the mesophase is formed by the heat treatment under this condition, the solvent insoluble portion including mesophase is easily separated through spontaneous precipitation or filtration. The separation of the mesophase through the filtration does not cause clogging of the mesh of the filter different from the filtration of free carbon and is very easy. Thereafter, the solvent is removed through distillation to obtain the pitch having no free carbon. This pitch is heat-treated at the second stage to form the mesophase, whereby the precursor pitch for carbon fiber is obtained. This precursor has a softening point of higher than 300° C., 80–95% by weight of benzene insoluble portion, 20–60% by weight of quinoline insoluble portion and less than 800 ppm of ash.

The precursor pitch for carbon fiber obtained according to the present invention is so-called "bulk mesophase pitch" containing 20–60% by weight of a quinoline insoluble portion. When this pitch is observed with a polarizing microscope, it can be seen that an isotropic pitch component is dispersed in the whole optical anisotropic texture. The ratio of the optical anisotropic texture observed under the polarizing microscope is 80–95%. It has been found that such a pitch is excellent in the spinnability and infusibility and can provide carbon fiber having high strength and Young's modulus. The carbon fiber formed of the mesophase pitch has various properties which have never been seen in the carbon fibers made of isotropic precursor pitch containing no mesophase. That is, the carbon fiber made of the mesophase pitch according to the present invention show high Young's modulus even at the treating temperature of 1,000° C. and the tensile strength and both the Young's modulus are noticeably more improved by the graphitizing treatment.

The most suitable precursor pitch for carbon fiber is the mesophase pitch having 80–95% by weight of benzene insoluble portion and 20–60% by weight of quinoline insoluble portion. When the benzene insoluble portion is less than 80% by weight and the quinoline insoluble portion is less than 20% by weight, the mesophase portion and the isotropic pitch portion in the mesophase pitch are separated and such a pitch cannot be spun. When the benzene insoluble portion is more than 95% by weight and the quinoline insoluble portion is more than 60% by weight, the melt viscosity of the mesophase pitch is considerably high and the spinning is infeasible. In the mesophase pitch having 80–95% by weight of benzene insoluble portion and 20–60% by weight of quinoline insoluble portion, the mesophase portion and the isotropic pitch portion are present in the uniform system and the melt viscosity at the spinning temperature is not high and the spinnability is excellent.

Thus, the mesophase pitch having a softening point of higher than 300° C., 80–95% by weight of benzene insoluble portion and 20–60% by weight of quinoline insoluble portion is suitable for the precursor pitch for carbon fiber and is excellent in the uniformity of the system, thermal stability, spinnability and infusibility, and is high in the carbonization yield, is few in the impurities, such as free carbon, heteroatom, inorganic substances and the carbon fiber formed of this pitch has high strength and Young's modulus.

A method for preparing the precursor for carbon fiber by heat-treating in the second stage the pitch containing no free carbon which has been obtained by the heat treatment in the first stage, is a simple one which comprises heating the pitch under atmospheric pressure or a reduced pressure in an inert gas atmosphere to form the mesophase pitch as mentioned above. The obtained precursor pitch is excellent in the thermal stability and is suitable for spinning, because the high molecular weight components having high thermal reactivity and heteroatom present in the raw material pitch are removed by the heat treatment at the first stage. Furthermore, since the raw material of pitch is coal tar pitch rich in the aromatic property and the heat treatment is applied at the first stage, the resulting pitch containing no free carbon is composed of relatively large aromatic molecules. Therefore, in the mesophase pitch obtained in the second stage, the mesophase component and the isotropic component are present in a uniform system.

The heat treatment of the pitch containing no free carbon at the second stage intends to produce the bulk mesophase pitch having 20–60% by weight of quinoline insoluble portion and 80–95% by weight of benzene insoluble portion and it has been found from a large number of experiments that the heat treatment temperature (T°C.) and the time ($\theta$ min) holding this temperature have the following relation.

$$600-1.2T \leqq \theta \leqq 1{,}800-3.6T \quad (1)$$

(provided that $350 \leqq T \leqq 500$)

That is, if the heat treatment temperature (T°C.) and the time ($\theta$ min) holding this temperature satisfy the requirement of the above equation (1), the bulk mesophase pitch having 20–60% by weight of quinoline insoluble portion and 80–95% by weight of benzene insoluble portion can be obtained. This bulk mesophase pitch becomes the precursor pitch for high performance carbon fibers (abbreviated as "HP carbon fibers" hereinafter) having high strength and high elasticity.

When the pitch containing no free carbon is heat-treated, a precursor pitch for general purpose carbon fiber (abbreviated as "GP carbon fiber" hereinafter) having low elasticity is obtained but this pitch is an isotropic pitch and is different from the mesophase pitch in the composition. In this case, it has been found that the heat treatment temperature (T°C.) and the time ($\theta$ min) holding this temperature have the following relation.

$$\theta \leqq 200-0.4T \quad (2)$$

(provided that $350 \leqq T \leqq 500$)

The relations of the above equations (1) and (2) are shown in FIG. 1.

As seen from FIG. 1, when the bulk mesophase pitch which is the precursor pitch of HP carbon fiber is compared with the isotropic pitch which is the precursor pitch of GP carbon fiber, the heat treatment holding time of the former pitch is longer than that of the latter pitch.

Ash which is the impurity in the precursor pitch becomes a cause which forms voids in carbon fibers or deteriorates the strength, so that the amount of the remaining free carbon is preferred to be as small as possible but the precursor pitch according to the present invention is very clean as the ash being less than 300 ppm and is very excellent as the carbon fiber precursor.

This precursor pitch is melt-spun at a temperature higher by 20°–40° C. than the softening point through a usual melt-spinning.

The spun fibers may be subjected to an infusing treatment according to air oxidation without effecting pretreatment by using an oxidizing agent, such as ozone oxidation or sulfuric acid. After this infusing treatment, the spun fibers are fired and carbonized by raising temperature up to about 1,000° C. in an inert gas such as Ar, $N_2$ to obtain carbon fibers. By further firing and graphitizing the carbon fibers at a temperature of higher than 2,000° C., graphite fibers having high strength and Young's modulus can be obtained without carrying out drawing step and the like.

The following examples are given for the purpose of illustration of this invention and are not intended as limitations thereof.

EXAMPLE 1

Coal tar soft pitch containing free carbon was heated at 450° C. in an inert gas atmosphere for 60 minutes to form 25% by weight of mesophase and then the thus treated pitch was extracted with tar oil and high molecular weight components which are mainly mesophase, were filtered off. The filtrate was vacuum-distilled to recover the solvent and to obtain pitch having a softening point of 90° C., 12% by weight of benzene insoluble portion, a trace of quinoline insoluble portion and containing no free carbon. The obtained pitch was heat-treated at 465° C. under vacuum degree of 20 mmHg in $N_2$ inert gas atmosphere to obtain mesophase pitch having a softening point of 355° C., 91.9% by weight of benzene insoluble portion and 55.2% by weight of quinoline insoluble portion. When this pitch was observed with a polarizing microscope, it was seen that an isotropic pitch component was dispersed in the whole optical anisotropic texture. The ratio of the optical anisotropic texture was 86%. This mesophase pitch was melt-spun at 385° C. at a take-up rate of 300–500 m/min and the spun fiber was oxidized in air at 320° C. and subsequently carbonized at 1,000° C. in argon atmosphere to obtain carbon fiber. This fiber had a fineness of 12–14 μm, a tensile strength of 140 kg/mm$^2$ and Young's modulus of 8.4 t/mm$^2$. Furthermore, this fiber was graphitized at 2,600° C. in argon atmosphere to obtain graphite fiber. This fiber had a fineness of 11–13 μm, a tensile strength of 240 kg/mm$^2$ and Young's modulus of 48 t/mm$^2$.

EXAMPLE 2

The pitch containing no free carbon obtained in the first heat treatment stage in Example 1 was heated at 465° C. under atmospheric pressure for 30, 60 and 180 minutes. At this time, $N_2$ inert gas was flowed at a flow rate of 5 l/min based on 300 g of the pitch. The pitches in the heat treatment for 30, 60 and 180 minutes are referred to as (I), (II) and (III) and the obtained results are shown in the following Table 1. In the pitch (I), the mesophase portion and the isotropic pitch portion were separated upon melt-spinning and the spinning was infeasible. The pitch (III) was considerably high in the melt viscosity and was impossible in the spinning. Only the mesophase pitch of the pitch (II) was able to be melt-spun at 370° C. at a take-up rate of 300–500 m/min. The spun fiber was oxidized in air at 320° C. and then carbonized at 1,000° C. in argon atmosphere to obtain carbon fiber. This fiber had a fineness of 12–14 μm, a tensile strength of 130 kg/mm$^2$ and Young's modulus of 8.6 t/mm$^2$. Furthermore, the graphitization was effected at 2,600° C. in argon atmosphere to obtain graphite fiber. This fiber had a fineness of 11–13 μm, a tensile strength of 280 kg/mm$^2$ and Young's modulus of 43 t/mm$^2$.

TABLE 1

| | (I) | (II) | (III) |
|---|---|---|---|
| Softening point (°C.) | 310 | 350 | 380 |
| Benzene insoluble portion (wt %) | 60.2 | 93.7 | 98.2 |
| Quinoline insoluble portion (wt %) | 16.2 | 45.1 | 67.5 |
| Temperature at 100 poises (°C.) | 340 | 375 | 430 |
| Kind of mesophase | Small globular body | Bulk mesophase | Whole mesophase |
| Anisotropic portion ratio (vol %) | 30 | 94 | 100 |

COMPARATIVE EXAMPLE 1

Coal tar soft pitch containing free carbon was directly extracted with tar oil without effecting the heat treatment and a pitch having a softening point of 90° C. and containing a trace of quinoline insoluble portion and still containing free carbon was obtained through filtration. This pitch was heat-treated at 450° C. under vacuum degree of 20 mmHg in $N_2$ gas atmosphere for 60 minutes to obtain mesophase pitch having 82.8% by weight of benzene insoluble portion and 43.2% by weight of quinoline insoluble portion. This mesophase caused the phase separation between the mesophase portion and the isotropic pitch portion under the molten state and was impossible in the spinning.

What is claimed is:

1. A method for producing carbon fiber precursor pitch which comprises heating a coal tar soft or middle pitch at a temperature of 350°–500° C. at a first stage to form 10–30% by weight of mesophase, extracting the thus treated pitch with an aromatic solvent, separating and removing the solvent insoluble portion including mesophase to obtain a pitch containing no free carbon and further heat-treating the pitch containing no free carbon in an inert gas atmosphere under atmospheric pressure or a reduced pressure at a second stage to form bulk mesophase pitch containing 20–60% by weight of quinoline insoluble portion.

2. A method as claimed in claim 1, wherein the heat treatment of the pitch containing no free carbon at the second stage is effected under the following condition $$600-1.2T \leqq \theta \leqq 1{,}800-3.6T$$

(provided that $350 \leqq T \leqq 500$)

wherein T(°C.) is the temperature of the heat treatment and $\theta$(min) is the time for which said temperature is held.

* * * * *